US005791964A

United States Patent [19]

Pohlman

[11] Patent Number: 5,791,964

[45] Date of Patent: Aug. 11, 1998

[54] RATCHET DRIVE FOR CONSTRUCTION TOY SET

[75] Inventor: Joe K. Pohlman, Los Angeles, Calif.

[73] Assignee: Mattel, Inc., El Segundo, Calif.

[21] Appl. No.: 796,763

[22] Filed: Feb. 6, 1997

[51] Int. Cl.[6] ..... A63H 33/12

[52] U.S. Cl. ..... 446/103; 446/93; 446/468

[58] Field of Search ..... 446/85, 93–96, 446/102, 103, 104, 452, 460, 468

[56] References Cited

U.S. PATENT DOCUMENTS

| | | | |
|---|---|---|---|
| 2,742,735 | 4/1956 | Sommerhoff | 446/456 |
| 3,232,005 | 2/1966 | Lahr | 446/460 |
| 3,286,397 | 11/1966 | Lohr | 446/460 |
| 3,902,739 | 9/1975 | Kimura | 280/249 |
| 4,327,517 | 5/1982 | Schwager | 446/460 |
| 4,761,014 | 8/1988 | Huang | 280/258 |
| 5,090,934 | 2/1992 | Quercetti | 446/93 |

FOREIGN PATENT DOCUMENTS

| | | | |
|---|---|---|---|
| 197809 | 9/1978 | Germany | 446/460 |
| 2909557 | 9/1990 | Germany | 446/468 |
| 2197217 | 5/1988 | United Kingdom | 446/95 |

*Primary Examiner*—Robert A. Hafer
*Assistant Examiner*—Laura Fossum
*Attorney, Agent, or Firm*—Roy A. Ekstrand

[57] ABSTRACT

A ratchet mechanism includes an outer gear having a recess formed therein and an aperture for supporting the gear upon a shaft. The outer wall of the recess defines a plurality of angled facets forming a saw-tooth configuration. A ratchet pawl includes a pair of opposed resilient spring tabs which engage the angled facet saw-tooth combination in one direction of rotation while disengaging in the opposite direction. A second gear is secured to the ratchet pawl and defines an aperture for rotational support upon a shaft. A frame supports the ratchet mechanism in engagement with a pivotally supported drive arm. The drive arm includes a gear segment having a plurality of gear teeth engaging one of the gears of the ratchet mechanism. The drive arm further includes a coupling flange at the opposite end from the gear segment which is securable to a source of reciprocating power. A bevel gear engages the remaining gear of the ratchet mechanism and is rotatably supported upon the frame by a driven shaft. The supporting frame for the ratchet mechanism and driven gear is formed entirely of construction toy set elements and couplers which are secured together in a snap-fit attachment. The supporting frame elements are further coupleable to additional structures fabricated of construction toy set elements and couplers.

3 Claims, 2 Drawing Sheets

FIG. 3
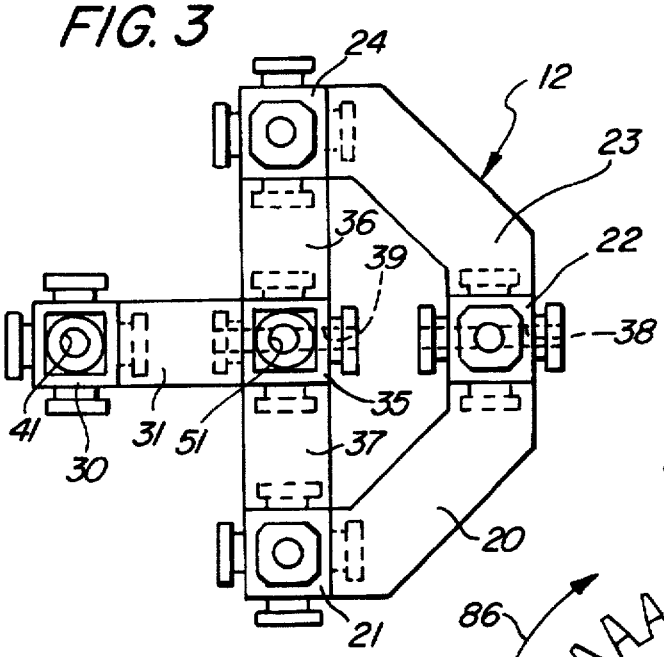
FIG. 4
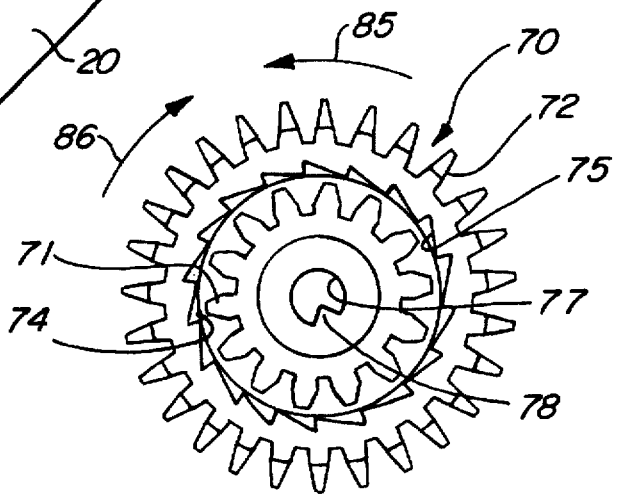
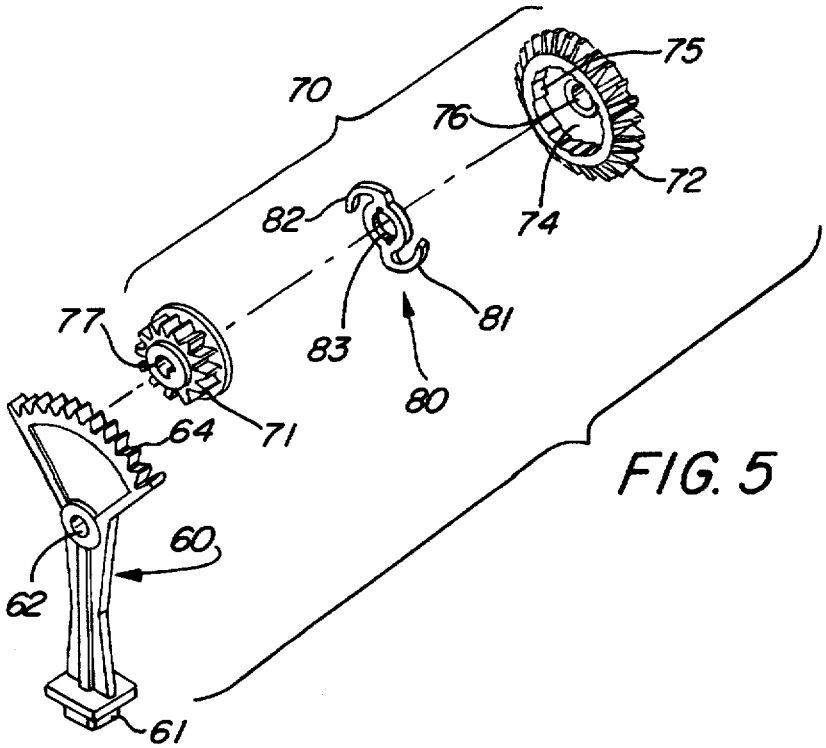
FIG. 5

RATCHET DRIVE FOR CONSTRUCTION TOY SET

CROSS-REFERENCE TO RELATED APPLICATION

This application is related to a copending application entitled CONSTRUCTION TOY SET FOR ASSEMBLING A STEERABLE TOY VEHICLE filed Feb. 6, 1997 and having Ser. No. 08/796,252 filed on behalf of the applicant and is assigned to the assignee of the present application and which is incorporated herein by reference.

FIELD OF THE INVENTION

This invention relates generally to construction toys and particularly to a combination of construction toy elements which may be fabricated to form a steerable toy vehicle.

BACKGROUND OF THE INVENTION

Construction toy playsets have been provided in different forms for many decades. Earliest construction toy sets provided a plurality of elongated metal elements together with suitable fastening devices to form various apparatus and play structures. Other early construction toy playsets utilize various elongated elements having end pegs together with coupling elements formed of wood or similar material having plural peg receiving passages allowing the pegged elements to be assembled to form various structures and toy apparatus. Construction toy playsets provide substantial developmental activity for the child user and thus are very well received and appreciated by educators and parents. The challenge for providing construction toy sets which enjoy commercial success is the dual roll of entertainment and amusement on one hand and child developmental skills on the other. In order for the child user to maximize the developmental activity, the user must remain interested in and challenged by the toy playset. The amusement and entertainment aspects of the toy playset provide the primary motivation for use which leads to the desired developmental skills.

Recognizing the enormous success of construction toy sets, practitioners in the art have, through the years, provided a virtually endless variety of such construction sets. Modern construction toy sets utilize large numbers of molded plastic parts which form cooperating interlock or snap-fit attachments to provide maximum flexibility and challenge for the user. As a result, construction toy sets are provided which facilitate assembling a great variety of items ranging from structural dwellings to toy vehicles or the like. In many instances, practitioners provide various specialty items within the plurality of generic construction elements to facilitate the assembly of challenging devices or apparatus.

U.S. Pat. No. 3,234,683 issued to Christiansen sets forth a TOY BUILDING ELEMENT INCLUDING A ROTATABLE BUSHING having plural interlocking building elements which accommodate a rotatable bushing and shaft combination. As a result, structures such as rotatable wheels may provided.

U.S. Pat. No. 5,069,647 issued to Zuviria sets forth a SOLID RECTANGULAR BUILDING BLOCK FOR TOY BUILDING SET having a plurality of block structures defining plural ribs and grooves allowing the blocks to interlock. Additional elements may be secured to the blocks such as wheel shafts or the like to enhance flexibility.

U.S. Pat. No. 5,310,376 issued to Mayuzumi, et al. sets forth a TOY THAT CAN BE ASSEMBLED INDEPENDENTLY BY A CHILD having a planar base member defining a plurality of peg receiving holes therein together with a plurality of coupling elements supporting plural outwardly extending pegs. Elongated flexible elements are interlockably received upon the coupling elements allowing various structures to be fabricated.

U.S. Pat. No. 3,604,130 issued to Forsstrom sets forth a CONSTRUCTION SERIES FOR MOLECULAR MODELS having a plurality of generally spherical interlocking elements which may be assembled to represent various atoms and molecules.

U.S. Pat. No. 4,109,398 issued to Hida sets forth an CONSTRUCTION TYPE EDUCATIONAL AND AMUSEMENT DEVICE having a basic element which defines a generally spherical hollow module or capsule having adjuncts which may be interconnected and operatively assembled into a large number of different configurations to form various apparatus.

U.S. Pat. No. 4,509,929 issued to Zawitz sets forth an ANNULAR SUPPORT DEVICE WITH PIVOTAL SEGMENTS having a plurality of torus segments interconnectable end to end to form an annular loop in which each segment is independently pivotal to form various shapes.

U.S. Pat. No. 4,631,040 issued to Shiraishi sets forth a CONSTRUCTION TOY SET having a variety of component parts including bases, housings and auxiliary members. Male and female connecting elements attached to the respective components allow for assembly in a variety of configurations.

U.S. Pat. No. 4,764,143 issued to Gat, et al. sets forth ASSEMBLY TOYS FOR JOINING CYLINDRICAL OBJECTS having a plurality of devices for removably connecting a plurality of cylindrical objects. Each device includes apparatus for interconnecting to other devices at a variety of angles and for securing a cylindrical object.

U.S. Pat. No. 5,046,982 issued to Erickson sets forth CONSTRUCTION APPARATUS having a plurality of relatively flat components each having at least three sides. The apparatus further includes an elongated rod-like member extending along each side and in large corner portions between the members. A plurality of connectors are provided for interconnecting adjacent sides of members to form structures.

In many construction sets, apparatus is provided for specialized assembly such as toy vehicles or the like. For example, U.S. Pat. No. 4,802,876 issued to Bertrand sets forth an AXLE STRUCTURE AND AXLE JOINT FOR CONSTRUCTION TOY ASSEMBLY having a base plate, an abutment plate normal to one edge of the base plate, a cross-shaped columnar connector perpendicular to the base plate and a cross-shaped shaft perpendicular to the abutment shape. The shaft defines bulges at its free end and is attachable to the cross-shaped structure.

U.S. Pat. No. 5,071,384 issued to Poulsen sets forth a STEERING MECHANISM for use with toy building sets to assemble devices such as toy vehicles. The mechanism includes rack means and a pinion cooperating therewith.

U.S. Pat. No. 4,690,656 issued to Friedman, et al. sets forth WHEEL AND WINCH ASSEMBLIES utilizing identical hubs and axles in a toy construction set. A special block having a axle projecting therefrom is provided and a hub mechanism is receivable upon the shaft to support a resilient tire.

U.S. Pat. No. 4,599,077 issued to Vuillard sets forth a MODULAR TOY while U.S. Pat. Nos. 4,202,132 and 4,136,482 both issued to Fischer set forth interacting structural elements generally related to construction toy sets.

While the foregoing described prior art devices have improved the art generally and have in some instances enjoyed commercial success, there remains nonetheless a continuing need in the art for evermore improved, interesting and challenging construction toy sets.

SUMMARY OF THE INVENTION

Accordingly, it is a general object of the present invention to provide a novel drive mechanism for use in a construction toy set. It is a more particular object of the present invention to provide a novel drive mechanism in a construction toy set which facilitates assembling complex structures which combine reciprocating and rotational elements. It is a still more particular object of the present invention to provide an improved drive mechanism in a construction toy set which facilitates coupling a source of reciprocating motion to a user of rotational power and the reverse.

In accordance with the present invention, there is provided a ratchet drive for use in a construction toy set, the ratchet drive comprising: a support frame having a plurality of construction toy elements coupled together by a plurality of couplers in a snap-fit assembly; a drive arm pivotally supported on the support frame having a coupling end and a gear segment; an output gear rotatably supported upon the support frame; and a ratchet mechanism, supported upon the support frame, having a first gear engaging the gear segment, a second gear engaging the output gear, and a unidirectional drive coupling between the first and second gears, the support frame having means for attachment to additional construction toy elements.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a top view of the upper frame portion of the present invention ratchet drive for construction toy set;

FIG. 4 sets forth an enlarged view of the ratchet mechanism used in the present invention ratchet drive for construction toy set; and FIG. 5 sets forth a perspective assembly view of a portion of the present invention ratchet drive for construction toy set showing the ratchet mechanism used therein.

DESCRIPTION OF THE PREFERRED EMBODIMENT

Figure 1:
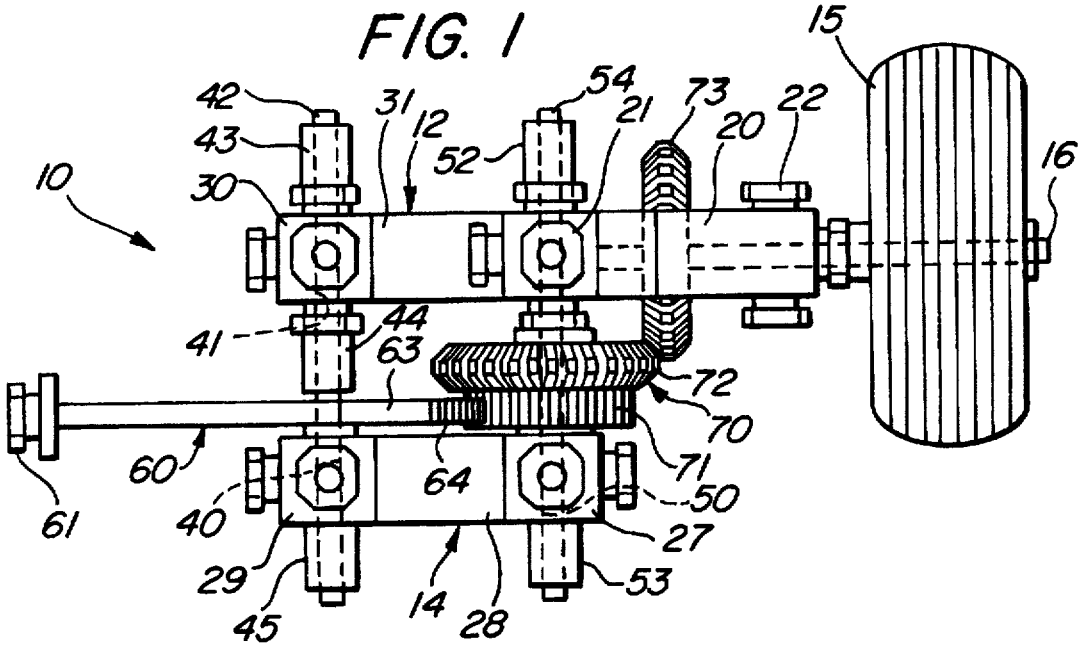
FIG. 1 sets forth a side elevation view of a ratchet drive for construction toy set constructed in accordance with the present invention.

FIG. 1 sets forth a side elevation view of a ratchet drive for construction toy set constructed in accordance with the present invention and generally referenced by numeral 10. For purposes of illustration, FIGS. 1, 2 and 3 set forth the present invention ratchet drive for construction toy set supported within a typical construction toy set frame such as would be utilized in employing the present invention ratchet drive. It will be understood, however, that different combinations of construction toy elements may be utilized in place of the supporting frames shown in FIGS. 1 through 3 to accommodate the different apparatus within a construction toy set environment. In addition, in the anticipated use of the present invention ratchet drive for construction toy set, it is anticipated that the upper and lower frame portions supporting the present invention ratchet drive would be further coupled to other construction toy elements within a more complex structure to more fully utilize the present invention drive.

More specifically, FIG. 1 sets forth ratchet drive 10 supported by an upper frame 12 and a lower frame 14. The structure of upper frame 12 is set forth below in FIG. 3 in greater detail. For purposes of illustration, upper frame 12 and lower frame 14 are fabricated utilizing the various angle and beam elements together with snap-fit couplers of the type shown and described in the above-referenced application. Suffice it to note here that the basic structural elements used in fabricating upper frame 12 and lower frame 14 include a plurality of couplers which are snap-fit attachable either straight or angle beam elements to provide the desired structure. Thus, upper frame 12 includes an angle element 20 secured to a coupler 22 at one end and a coupler 21 at the remaining end. Upper frame 12 further includes a beam element 31 secured to a coupler 30. Upper frame 12 is set forth below in FIG. 3 in greater detail. However, suffice it to note here that upper frame 12 further includes a coupler 22, an angle element 23 and a coupler 24. As is also better seen in FIG. 3, upper frame 12 further includes a coupler 35 secured between couplers 24 and 21 by beam elements 37 and 36.

Returning to FIG. 1, coupler 30 of upper frame 12 defines an aperture 41 extending therethrough which receives a shaft 42 supporting a sleeve 43 above coupler 30 and a sleeve 44 beneath coupler 30. Thus, shaft 42 is supported within coupler 30 and sleeves 43 and 44. With temporary reference to FIG. 3, coupler 35 defines an aperture 51. Returning to FIG. 1, a shaft 54 is received within aperture 51 and extends downwardly through coupler 35 and therebeyond. A sleeve 52 is received upon shaft 54 to maintain the position of shaft 54 within coupler 35 (seen in FIG. 3).

As is better seen in FIG. 3, coupler 22 defines a horizontally oriented aperture 38 while coupler 35 defines a horizontally oriented aperture 39. Returning to FIG. 1, a shaft 16 extends through aperture 38 of coupler 22 and partially into aperture 39 of coupler 35. Shaft 16 receives a wheel 15 secured and coupled to shaft 16 such that rotation of shaft 16 causes a corresponding rotation of wheel 15. A gear 73, having a plurality of angled teeth or bevel teeth, is received upon and supported by shaft 16. By means not shown but in accordance with conventional fabrication techniques, shaft 16 engages gear 73 such that rotation of gear 73 produces a corresponding rotation of shaft 16.

Thus, shafts 42 and 54 are vertically supported within upper frame 12 while shaft 16 is horizontally supported within upper frame 12. In further accordance with the present invention, a ratchet mechanism 70 includes a bevel gear 72 rotatably supported upon shaft 54 in engagement with gear 73. Ratchet 70 further includes a gear 71 which, as is set forth below in FIG. 5 in greater detail, is coupled to gear 72 in a unidirectional or ratcheted coupling. Gear 71 is also rotatably supported upon shaft 54. An elongated drive arm includes an aperture 62 (seen in FIG. 5) which receives shaft 42 to pivotally support arm 60. Arm 60 includes a coupling flange 61 at one end and a gear segment 63 at the remaining end. Gear segment 63 includes a plurality of gear teeth 64 which operatively engage gear 71 of ratchet mechanism 70.

A lower frame 14 includes a pair of couplers 27 and 29 having respective apertures 50 and 40 formed therein. Couplers 27 and 29 are commonly joined to a beam element 28. Shaft 42 passes through aperture 40 of coupler 29 and further receives sleeve 45. Similarly, shaft 54 passes through aperture 50 of coupler 27 and receives sleeve 53. Lower frame 14 functions to provide further support for shafts 42 and 54 as well as maintaining alignment of arm 60 and ratchet assembly 70 within the present invention ratchet drive.

It will be understood that both lower frame 14 and upper frame 12 are normally coupled to additional construction toy elements (not shown) to house the present invention ratchet drive within a construction toy set assembly. Similarly, in the anticipated use of the present invention ratchet drive, coupling flange 61 is further coupled to a source of reciprocating power within the remaining construction toy set elements (not shown). Suffice it to note here that coupling flange 61 is coupled to a reciprocating or linearly moving element.

Figure 2:
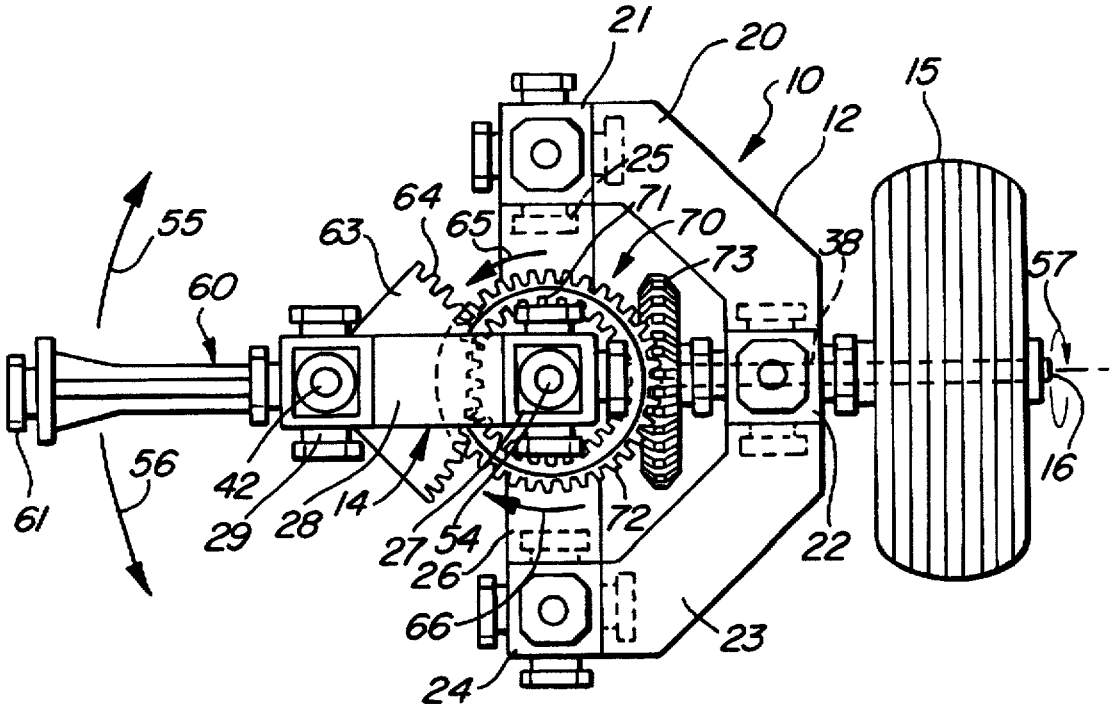
FIG. 2 sets forth a bottom view of the present invention ratchet drive for construction toy set.

FIG. 2 sets forth a bottom view of ratchet drive assembly 10. As described above, ratchet drive 10 includes an upper frame 12 and a lower frame 14. Lower frame 14 is formed of a pair of couplers 27 and 29 joined by a beam element 28. Coupler 29 supports a shaft 42 while coupler 27 supports a shaft 54. Upper frame 12 includes a pair of angle elements 20 and 23 commonly joined to a coupler 22. Upper frame 12 further includes couplers 21 and 24 joined to angle elements 20 and 23 respectively. Upper frame 12 also includes a pair of beam elements 25 and 26 joined to and extending inwardly from couplers 21 and 24 respectively. As is better seen in FIG. 3, beam elements 36 and 37 are commonly joined to a coupler 35. As is also better seen in FIG. 3, upper frame 12 includes a beam element 31 joined to coupler 35 and a coupler 30 joined to beam element 31 to complete upper frame 12.

Returning to FIG. 2, it will be recalled that the function of upper frame 12 and lower frame 14 is to support the present invention ratchet drive. Accordingly, coupler 22 defines an aperture 39 which receives shaft 16. Shaft 16 supports a wheel 15 secured thereto together with a gear 73. Both gear 73 and wheel 15 are secured to shaft 16 to provide a lock therebetween using conventional fabrication techniques. Accordingly, rotation of gear 73 produces a corresponding rotation of shaft 16 and thereby wheel 15. Ratchet drive 10 further includes a ratchet assembly 70 having a gear 72 engaging gear 73 and a gear 71. As is better seen in FIG. 5, gears 71 and 72 are coupled by a ratchet pawl 80 to provide unidirectional ratcheted coupling between gears 71 and 72. Gears 71 are rotatably supported upon shaft 54.

Drive arm 60 is pivotally supported upon shaft 42 via aperture 62 (seen in FIG. 5). As described above, arm 60 includes a coupling flange 61 at one end and a gear segment 63 at the remaining end. Gear segment 63 in turn defines a plurality of gear teeth 64 which engage gear 71.

In operation, coupling flange 61 of arm 60 is coupled to a source of reciprocating power (not shown) which, for example, produces reciprocating motion of arm 60 about shaft 42 in the manner indicated by arrows 55 and 56. The pivotal motion of arm 60 produces a corresponding pivotal motion of gear segment 63 causing 71 of ratchet mechanism 70 to be pivoted back and forth upon shaft 54. The ratchet coupling between gears 71 and 72 described below causes the pivoting motion of gear 71 produced by gear segment 63 to drive gear 72 in the direction indicated by arrow 65 each time drive arm 60 is moved in the direction indicated by arrow 55. When drive arm 60 is returned in the direction indicated by arrow 56, gear segment 63 rotates gear 71 in the direction indicated by arrow 66. The ratchet coupling provided by ratchet pawl 80 (seen in FIG. 5) allows gear 71 to slip from engagement with gear 72 during this motion. Accordingly, gear 72 is not moved when drive arm 60 moves in the direction indicated by arrow 56.

Thus, as arm 60 is reciprocatingly moved in the directions indicated by arrows 55 and 56, gear 72 is intermittently advanced in the direction indicated by arrow 65. The intermittent single direction motion of gear 72 produces a corresponding intermittent single direction rotation of gear 73 and shaft 16 in the direction indicated by arrow 57. The rotation of shaft 16 in turn rotates wheel 15.

As a result, reciprocating motion applied to coupling flange 61 of drive arm 60 is converted by ratchet drive 10 to rotational single direction motion of wheel 15. It will be apparent to those skilled in the art that while wheel 15 is shown coupled to shaft 16 for illustration, other elements such as a pulley or a further gear arrangement may, alternatively, be coupled to shaft 16. The essential function of ratchet drive 10 is to provide a construction toy set with a novel and interesting subassembly which may form a portion of a greater assembly using the additional elements of the construction toy set.

FIG. 3 sets forth a top view of upper frame 12. As described above, upper frame 12 is fabricated using construction toy set elements having a plurality of couplers together with a plurality of angle elements and a plurality of beam elements. More specifically, upper frame 12 includes a pair of angle elements 20 and 23 joined to a coupler 22. Coupler 22 defines an aperture 38 extending therethrough. Upper frame 12 further includes a pair of couplers 21 and 24 secured to angle elements 20 and 23 respectively. A pair of beam elements 36 and 37 are commonly joined to a coupler 35 and to couplers 24 and 21 respectively. A coupler 30 is joined to coupler 35 by a beam element 31. Coupler 30 defines an aperture 41 while coupler 35 defines an aperture 51. Coupler 35 further defines an aperture 39 aligned with aperture 38 of coupler 22. As described above in the assembly of the present invention ratchet drive, apertures 41 and 51 of couplers 30 and 35 respectively receive and support shafts 42 and 54 respectively. As is also described above, aperture 38 of coupler 22 receives shaft 16 while aperture 39 of coupler 35 receives the interior end portion of shaft 16 (seen in FIG. 2).

FIG. 4 sets forth an enlarged view of ratchet mechanism 70. Ratchet mechanism 70 includes a gear 72 defining a recess 74 and an aperture 76 therein (aperture 76 seen in FIG. 5). Recess 74 in turn defines a plurality of angled facets 75 which form a "saw-tooth" arrangement of facets about the outer wall of recess 74. Ratchet mechanism 70 further includes a gear 71 having an aperture 77 formed therein. Aperture 77 in turn defines a key member 78 which engages a corresponding groove (not shown) formed in shaft 54 (seen in FIG. 1). As is better seen in FIG. 5, a ratchet pawl 80 having outwardly extending spring tabs 81 and 82 is captivated within recess 74 of gear 72.

An operation gear 71 is angularly oscillated in response to reciprocating movement of drive arm 60 as described above. The cooperation of ratchet pawl 80 and angled facets 75 produces operational coupling between gear 71 and gear 72 when gear 71 is rotated in the direction indicated by arrow 85. During this direction of rotation, tabs 81 and 82 of ratchet pawl 80 (seen in FIG. 5) engage the teeth formed by angled facets 75. Conversely, when gear 71 is rotated in the direction indicated by arrow 86 (that is to say during the return motion of arm 60), spring tabs 81 and 82 of ratchet pawl 80 (seen in FIG. 5) slide past the teeth formed by angled facets 75 and no engagement is provided between gears 71 and 72.

FIG. 5 sets forth a perspective assembly view of ratchet mechanism 70 together with drive arm 60. As described above, drive arm 60 defines an aperture 62 which rotatably supports drive arm 60 upon shaft 42 in the manner seen in FIG. 2. As is also described above, drive arm 60 defines a coupling flange 61 at one end and a gear segment 63 having gear teeth 64 at the opposite end. Ratchet mechanism 70 includes a gear 71 having an aperture 77 formed therein. While not seen in FIG. 5, gear 71 should be understood to include an engaging projection which receives and engages aperture 83 of ratchet pawl 80. Thus, ratchet pawl 80 includes an aperture 83 which secures ratchet pawl 80 to gear 71. Ratchet pawl 80 further includes a pair of resilient spring tabs 81 and 82. Ratchet assembly 70 further includes a gear 72 having a recess 74 and an aperture 76 formed therein. The outer wall of recess 74 defines a plurality of angled facets 75 which, as is better seen in FIG. 4, form a plurality of saw-tooth facets for engagement with ratchet pawl 80.

Thus, ratchet mechanism 70 is assembled by initially engaging ratchet pawl 80 upon gear 71 and thereafter compressing spring tabs 81 and 82 inwardly to facilitate the insertion of ratchet pawl 80 and a portion of gear 71 within recess 74. Once ratchet pawl 80 is received within recess 74, spring tabs 81 and 82 flex outwardly to provide the above-described single direction engagement or ratcheting action between gears 71 and 72. The ratchet mechanism together with drive arm 60 is then assembled within the above-described upper and lower frames as seen in FIGS. 1 and 2 to complete the installation of the present invention ratchet drive.

It will be apparent to those skilled in the art that the present invention ratchet drive for construction toy set may facilitate a great variety of interesting and amusing mechanism combinations for use in a further combination of construction toy set elements. Thus, the assembly provided is readily adapted to virtually any supporting arrangement of construction toy elements. As a result, the child user is able to employ an interesting and entertaining combination of reciprocating and rotational motion within various structures fabricated using the present invention ratchet drive for connection toy set.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A ratchet drive for use in a construction toy set, said ratchet drive comprising:

a support frame having a plurality of construction toy elements coupled together by a plurality of couplers in a snap-fit assembly;

a drive arm pivotally supported on said support frame having a coupling end and a gear segment;

an output gear rotatably supported upon said support frame; and a ratchet mechanism, supported upon said support frame, having a first gear engaging said gear segment, a second gear engaging said output gear, and a unidirectional drive coupling between said first and second gears, said unidirectional drive coupling including a plurality of angled facets on said second gear forming a saw-tooth pattern; and a ratchet pawl coupled to said first gear and defining a pair of spring tabs engaging said plurality of angled facets in a first direction of rotation and sliding in a nonengaging manner in a second direction of rotation, said support frame having means for attachment to additional construction toy elements and said second gear and said output gear are orthogonally positioned bevel gears.

2. A ratchet drive as set forth in claim 1 wherein said support frame includes:

an upper frame;

a lower frame; and a pair of shafts extending therebetween, said pair of shafts supporting said first and second gears on one shaft and said drive arm on the remaining shaft.

3. A ratchet drive as set forth in claim 2 wherein said upper and lower frames include couplers having apertures therethrough receiving said pair of shafts.

* * * * *